US006039676A

United States Patent [19]

Clive

[11] Patent Number: 6,039,676

[45] Date of Patent: Mar. 21, 2000

[54] TRAINING BIKE

[76] Inventor: Stevens Clive, 7F, No. 291, Ta Dun 4th St., Taichung, Taiwan

[21] Appl. No.: 09/390,375

[22] Filed: Sep. 7, 1999

[51] Int. Cl.[7] ..... A63B 21/00

[52] U.S. Cl. ..... 482/57

[58] Field of Search ..... 482/51, 57–65, 482/71, 70, 72, 908, 52, 53; D21/191, 198

[56] References Cited

U.S. PATENT DOCUMENTS

| | | | |
|---|---|---|---|
| 3,578,800 | 5/1971 | DiNepi | 482/57 |
| 3,750,479 | 8/1973 | Gause et al. | 482/57 |
| 4,577,860 | 3/1986 | Matias | 482/57 |
| 5,971,894 | 10/1999 | Chen | 482/57 |

*Primary Examiner*—Stephen R. Crow
*Attorney, Agent, or Firm*—Rosenberg, Klein & Lee

[57] ABSTRACT

A training bike includes a main column having a seat post retractably received in a first end thereof and a support bar connected to a second end of the main column. A cycling device having a crank with paddles is connected to the main column so that a user may sit on a seat on the seat post and steps on the paddles. A rear support is pivotally connected to the main column at the first end of the main column, and a handlebar tube is pivotally connected to the main column at a position where is lower than the position where the rear support is connected to the main column. The seat post and the rear support can be respectively pivoted toward the main column to be a compact size.

5 Claims, 4 Drawing Sheets

TRAINING BIKE

FIELD OF THE INVENTION

The present invention relates to a training bike, and more particularly to an foldable training bike which allows the frames of the training bike to be as compact as possible.

BACKGROUND OF THE INVENTION

A conventional training bike generally includes an X-shaped frame which has two upper ends one of which has a seat and the other upper end has a handlebar. Two lower ends of the X-shaped frame each have a transverse bar so as to firmly stand on the ground. A cycling means is connected to the front portion of the frame so that the user sits on the seat and holds the handlebar to rotate the cycling means by his/her feet. The frame of the training bike is so simple so that it is welcomed in the market. However, the intersectional portion of the X-shaped frame is not strong enough so that the frame will shake when the user steps the crank of the cycling means, this is partly because the sole intersectional portion of the X-shaped frame bears the total weight of the user. Besides, although the frame is foldable, the intersectional portion cannot be folded to be a compact size so that it is inconvenient for the user to store or transport the training bike.

The present invention intends to provide a foldable training bike whose frame is able to be folded to a compact size. The frame includes a rear support pivotally connected to the main column at the position which is higher than the position at which the handlebar tube is connected to the main column. The frame can effectively reduce the trembling of the frame when in use.

SUMMARY OF THE INVENTION

In accordance with one aspect of the present invention, there is provided a training bike comprising a main column having a seat post retractably received in a first end thereof and a support bar connected to a second end of the main column. A cycling means is connected to the main column and has a crank rotatably connected thereto. A rear support is pivotally connected to the main column at the first end of the main column, and a handlebar tube is pivotally connected to the main column at a position which is located lower than the position where the rear support is connected to the main column.

The training bike of the present invention is to provide a training bike which can be folded to let the handlebar tube and the rear support be folded adjacent to the main column so as to be easily stored and/or transported.

Another object of the present invention is to provide a training bike which will not tremble when in use.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
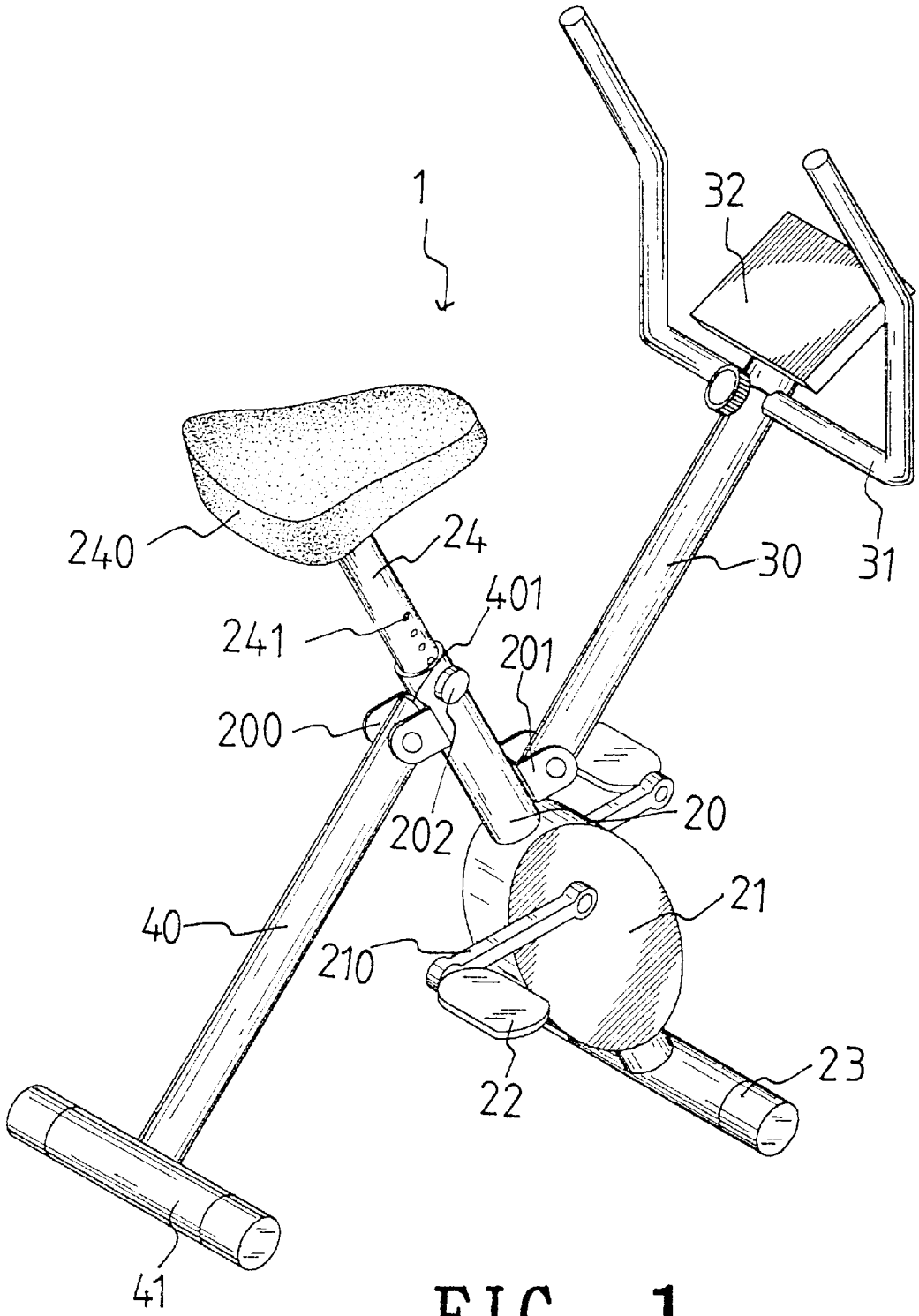
FIG. 1 is a perspective view of the training bike in accordance with the present invention.
Figure 2:
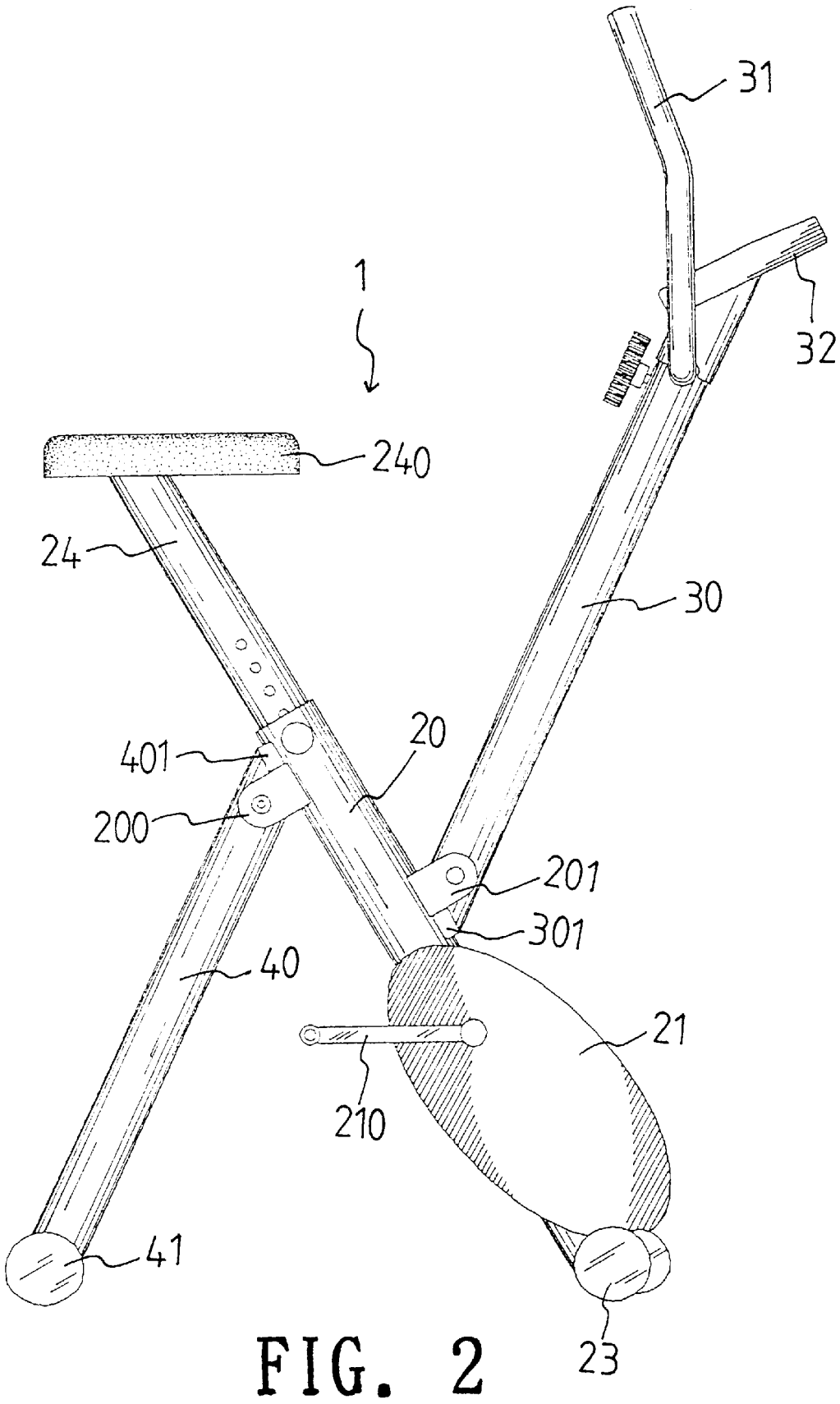
FIG. 2 is a side view to shoe the training bike of the present invention.

For a better understanding of the present invention, reference is made to FIGS. 1 and 2 for illustrating the training bike 1 in accordance with the present invention. The training bike 1 comprises a main column 20 having a seat post 24 retractably received in a first end thereof and a support bar 23 connected to a second end of the main column 20. A seat 240 is connected to the seat post 24 which has a lot of indents 241 in the outside thereof, and a bolt 202 extends through the main column 20 and is engaged with one of the indents 241 so as to position the seat post 24 relative to the main column 20. A cycling means 21 is connected to the main column 20 and a crank 210 with two paddles 22 is rotatably connected to the cycling means 21.

A rear support 40 is pivotally connected to the main column at the first end of the main column 20, wherein the main column 20 has two first lugs 200 extending radially outward therefrom so that the rear support 40 is pivotally connected between the two first lugs 200. A resilient pad 401 is connected between the rear support 40 and the main column 20. A bar 41 is connected transversely to the other end of the rear support 40.

A handlebar tube 30 is pivotally connected to the main column 20 at a position which is located lower than the position where the rear support 40 is connected to the main column 20. In other words, the main column 20 has two second lugs 201 extending radially outward therefrom so that the handlebar tube 30 is pivotally connected between the two second lugs 201. Similarly, a resilient pad 301 is connected between the handlebar tube 30 and the main column 20. A handlebar 31 is connected to the other end of the handlebar tube 30 and a illustration gauge 32 is connected to the handlebar 31 as known.

It is advantageous that the two connection points of the handlebar tube 30 and the rear support 40 are located at different height relative to the main column 20 so that the load of the user will not be concentrated at one point and is dispensed so that the training bike will not tremble when in use.

Figure 3:
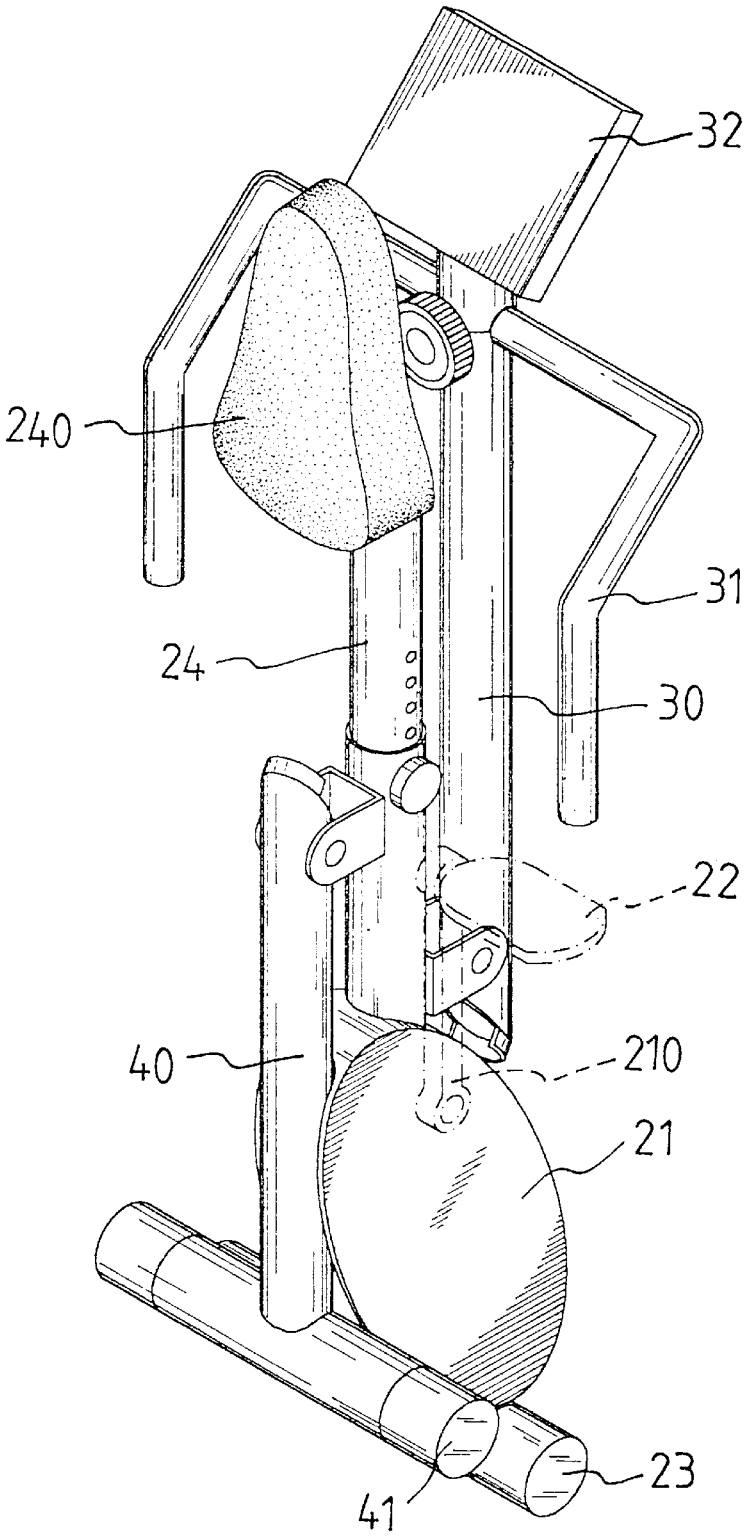
FIG. 3 is a perspective view to show the training bike of the present invention when being folded.
Figure 4:
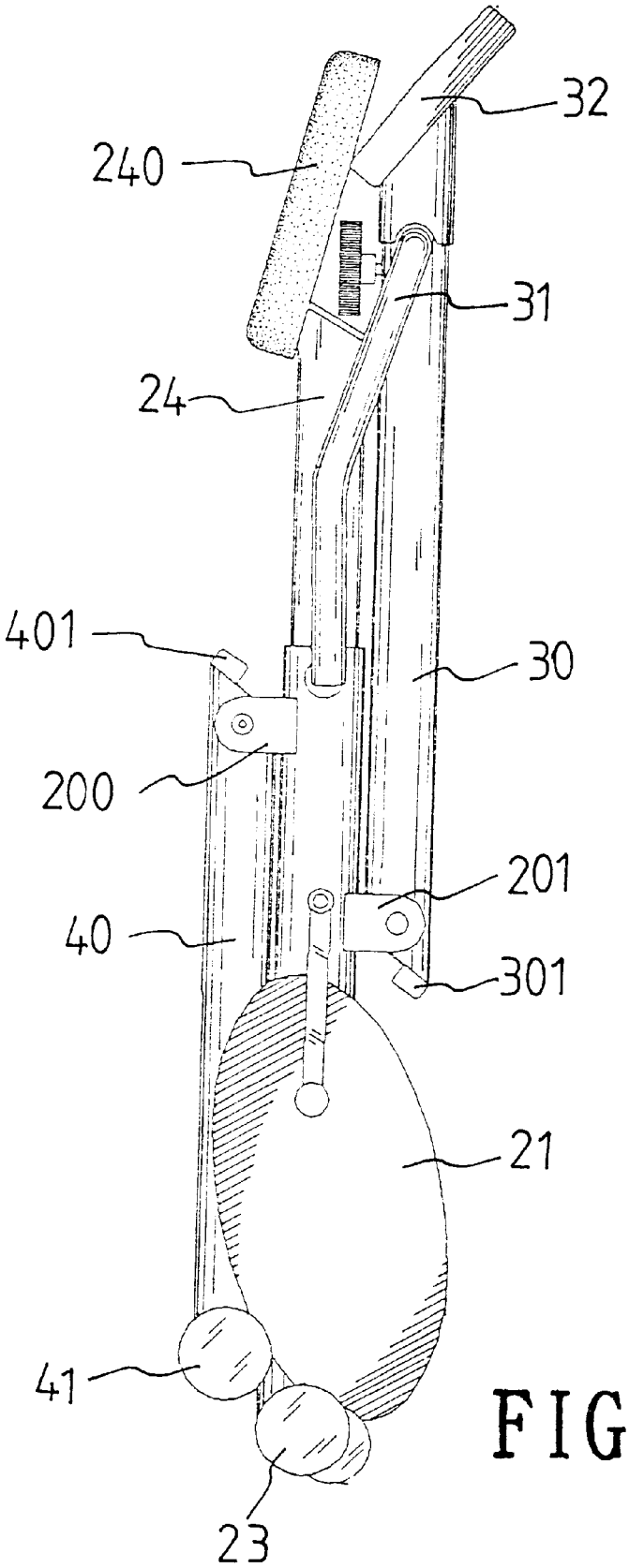
FIG. 4 is a side view to show the folded training bike of the present invention.

Referring to FIGS. 3 and 4, the rear support 40 and the handlebar tube 30 can be respectively pivoted toward the main column 20 as shown in FIGS. 3 and 4. The rear support 40 and the handlebar tube 30 are pivoted to a position in parallel with the main column 20 so that the folded frame of the training bike 1 is so small so that it is easily to be stored and/or transported.

While we have shown and described various embodiments in accordance with the present invention, it should be clear to those skilled in the art that further embodiments may be made without departing from the scope and spirit of the present invention.

What is claimed is:

1. A training bike comprising:

a main column (20) having a seat post (24) retractably received in a first end thereof and a support bar (23) connected to a second end of said main column (20), a cycling means (21) connected to said main column (20) and a crank (210) rotatably connected to said cycling means(21);

a rear support (40) pivotally connected to said main column at said first end of said main column (20), and a handlebar tube (30) pivotally connected to said main column (20) at a position which is located lower than said position where said rear support (40) is connected to said main column (20).

2. The training bike as claimed in claim 1, wherein said main column (20) has two first lugs (200) extending radially outward therefrom so that said rear support (40) is pivotally connected between said two first lugs (200).

3. The training bike as claimed in claim 2 further comprising a pad (401) connected between said rear support (40) and said main column (20).

4. The training bike as claimed in claim 1, wherein said main column (20) has two second lugs (201) extending radially outward therefrom so that said handlebar tube 30 is pivotally connected between said two second lugs (201).

5. The training bike as claimed in claim 4 further comprising a pad (301) connected between said handlebar tube (30) and said main column (20).

* * * * *